US008539901B2

(12) United States Patent
Chittum

(10) Patent No.: US 8,539,901 B2
(45) Date of Patent: Sep. 24, 2013

(54) BOAT CASTING PLATFORM

(76) Inventor: Harold T. Chittum, Merritt Island, FL (US)

( * ) Notice: Subject to any disclaimer, the term of this patent is extended or adjusted under 35 U.S.C. 154(b) by 268 days.

(21) Appl. No.: 12/931,364

(22) Filed: Feb. 1, 2011

(65) Prior Publication Data

US 2012/0192783 A1 Aug. 2, 2012

(51) Int. Cl.
*B63B 17/00* (2006.01)

(52) U.S. Cl.
USPC ..... 114/364

(58) Field of Classification Search
USPC ..... 114/361, 364; 182/112, 113, 118, 182/138
See application file for complete search history.

(56) References Cited

U.S. PATENT DOCUMENTS

| | | | | |
|---|---|---|---|---|
| 3,724,595 | A * | 4/1973 | Green | 182/118 |
| 6,098,750 | A * | 8/2000 | Reynolds et al. | 182/138 |
| 6,988,461 | B1 * | 1/2006 | James | 114/364 |
| 2009/0320738 | A1 * | 12/2009 | Blumberg | 114/364 |

* cited by examiner

*Primary Examiner* — Lars A Olson
*Assistant Examiner* — Anthony Wiest
(74) *Attorney, Agent, or Firm* — William M. Hobby, III

(57) ABSTRACT

A casting platform apparatus for a fishing boat includes a frame which can be attached to the bow of a boat. The frame has a floor to allow a fisherman to be supported thereon and includes both a handrail and a body support rail along with a fishing line collection net therebetween and a gate for entering onto and off the casting platform.

18 Claims, 2 Drawing Sheets

BOAT CASTING PLATFORM

BACKGROUND OF THE INVENTION

The present invention relates to a boat casting platform and especially to a casting platform for a fishing boat for supporting a fisherman during casting with a fishing rod.

A casting platform or casting deck generally is positioned on the front floor portion of a boat and is generally raised in order to give a fisherman a better view of the casting area and to give the fisherman more flexibility in movement during casting bait or an artificial lure or fly.

In the past, there have been various attachments for boats for supporting a fisherman. These attachments generally are mounted to the floor or to the bow of a boat and provide a fisherman with a seat or floor to stand on while fishing with a casting rod.

The casting platform is especially useful in fly fishing in which a fly fishing rod casts an artificial fly on the end of a fishing line. The fly line is heavy enough to send the fly to the target. Fly fishing differs from the use a spinner or bait casting rod which may have a weight or lure on the end of a line for casting. The weight pulls the line from a reel or from the basket during the forward motion of a cast. Once a fish is hooked, it can be retrieved onto a reel. A hooked fish is then fought on the reel.

The present invention is especially adapted for fly fishing and provides a casting platform which holds a fisherman in a raised position in order to get a better view of the casting area and allows more freedom of movement and at the same time, provides a place to keep the fishing line from tangling before a cast is made.

SUMMARY OF THE INVENTION

A casting platform for a fishing boat has a frame having a plurality of curved legs each having two ends and being attached together by a plurality of brace members extending perpendicular between the legs. A floor is supported on a plurality of the brace members for supporting a fisherman thereon. A handrail attaches to one end of the legs and a body support rail is supported with a plurality of body rail support members attached between the body support rail and a plurality of cross brace members. The body support rail is positioned inside the handrail for supporting a person thereagainst. A net is attached between the handrail and the body support rail to form a pocket for collecting fishing line or the like therein. Each leg member has a foot attached while the platform is attached to the bow of a fishing boat. Both the handrail and the body support rail are generally C-shaped with an opening therethrough with a gate to cover the openings therein. The gate includes a handrail member for attaching over the opening through the handrail and a body support rail member for attaching over the opening in the body support rail. The handrail gate member and the body support rail gate member are connected together for the removing and reattaching of the gate as a unit. The body support rail member has a pair of clips thereon for clipping onto a gate attaching protrusion attached to body rail support members. The frame is generally a tubular frame.

BRIEF DESCRIPTION OF THE DRAWINGS

Other objects, features, and advantages of the present invention will be apparent from the written description and the drawings in which.

DESCRIPTION OF AN EXEMPLARY EMBODIMENT

Figure 1:
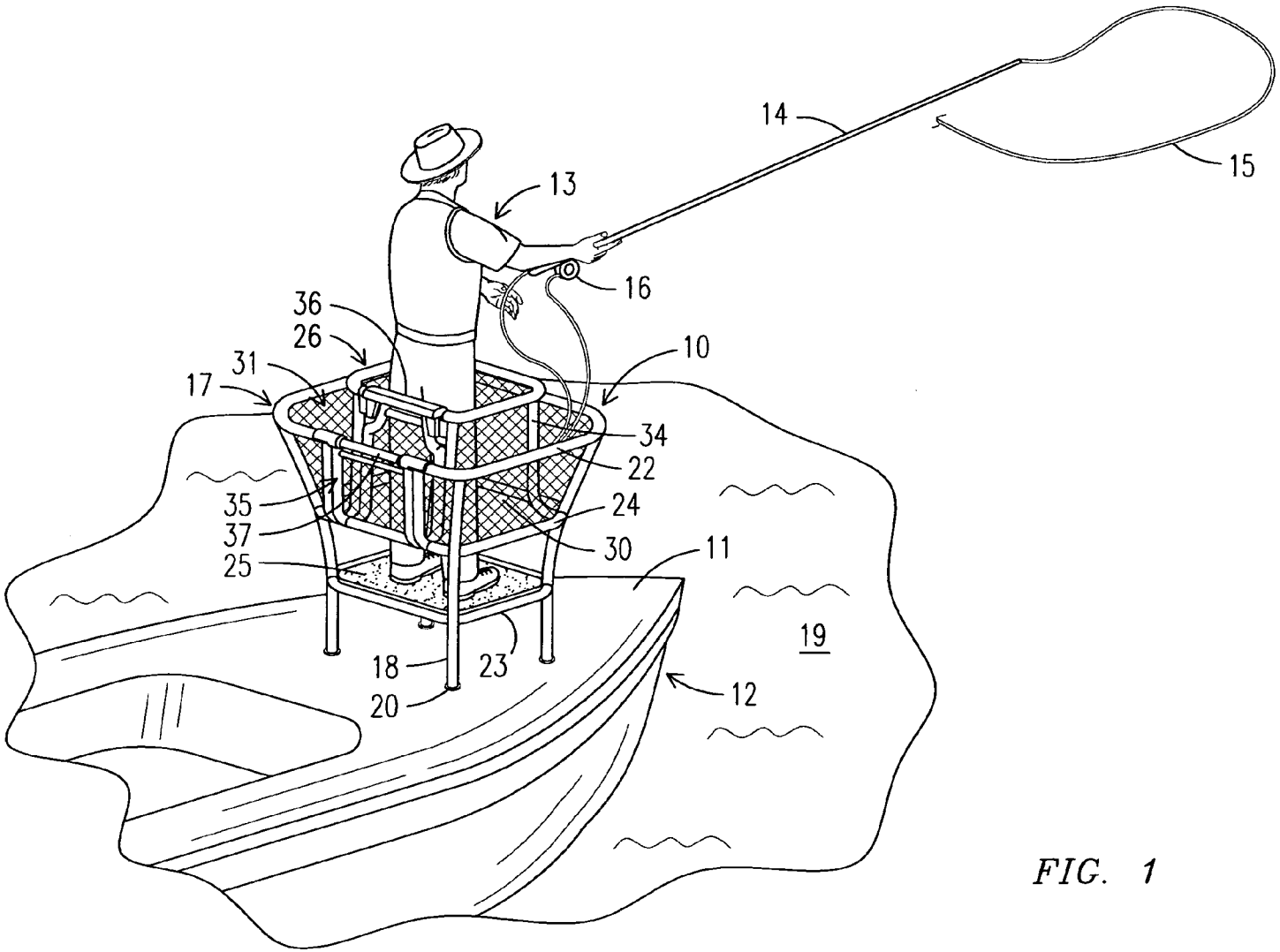
FIG. 1 is a perspective view of a casting platform in accordance with the present invention placed upon the bow of the boat having a fisherman supported therein.

Referring to the drawings and especially to FIG. 1, a casting platform 10 is shown attached to the bow 11 of a boat hull 12. The fishing platform 10 has a fisherman 13 standing therein holding a fly fishing rod 14 having the fishing line 15 extending therefrom. The fly rod 14 has a reel 16 attached thereto. The boat is shown floating in water 19.

Figure 2:
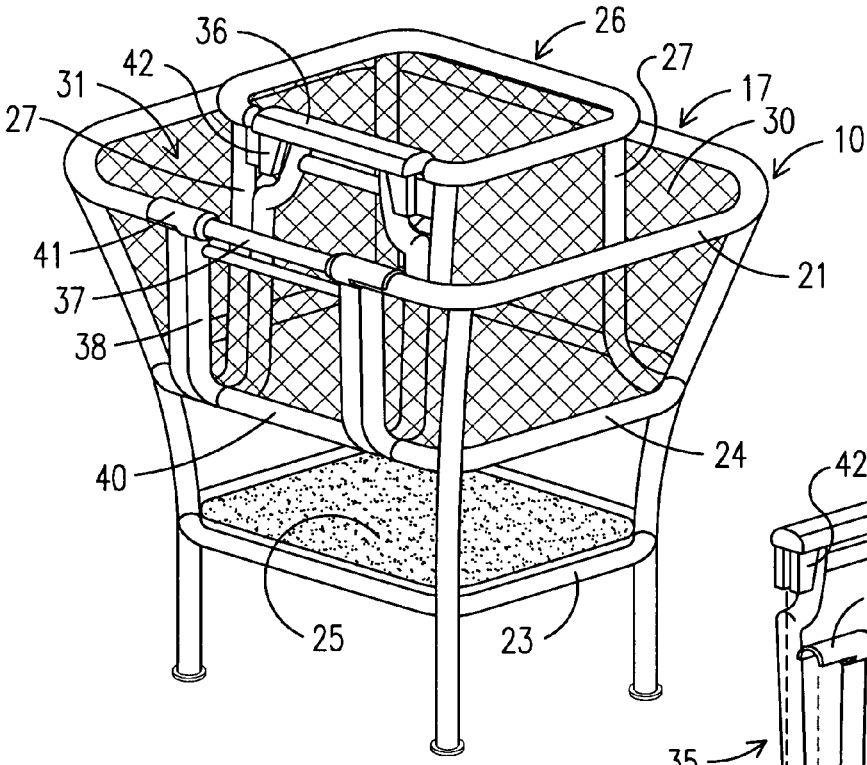
FIG. 2 is a perspective view of the casting platform of FIG. 1.
Figure 3:
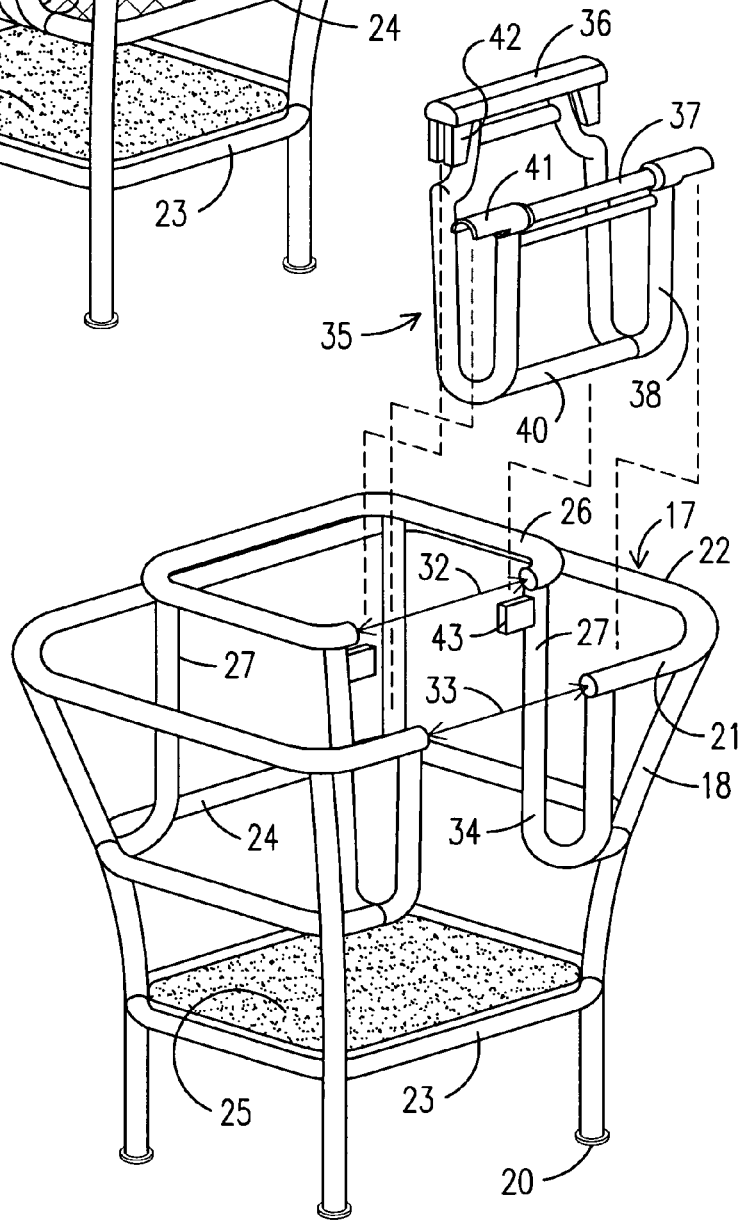
FIG. 3 is an exploded perspective view of the frame of the casting platform of FIGS. 1 and 2 illustrating the entryway gate onto the casting platform.

Referring more specifically to FIGS. 2 and 3, the casting platform 10 has a framework 17 having a plurality of legs 18. Each leg 18 is curved from foot 20 to an end position 21 which has a generally C-shaped handrail 22 attached thereto. The legs 18 have a plurality of cross-brace members 23, each cross brace member being attached between pairs of legs 18. Another plurality of cross brace members 24 are also attached between the legs 18. A floor 25 is attached to the cross brace members 23 for supporting a fisherman 13 thereon. A body support rail 26 is a generally C-shaped tubular rail which is supported inside the generally C-shaped handrail 22 by a plurality of body rail support members 27 which are attached to the cross brace members 24 and to the legs 18.

A net 30 is connected to the handrail 22 and to the body rail support members 27 to form a pocket 31 between the handrail 22 and the body support rail 26. This net pocket is especially useful for collecting fly line as illustrated in FIG. 1 in which a fisherman's hand is striping in a fly line.

The body support rail 26 has an opening 32 while the handrail 22 has an opening 33 therethrough. A U-shaped or curved rail support member 34 is connected between the rails 22 and 26. An entry gate 35, as more clearly seen in FIG. 3, has a body rail gate member 36 and a handrail gate member 37 with the rail members 36 and 37 being connected by a curved gate support members 38 and further braced with a cross gate brace 40 connecting the curved gate support members 38 together. This allows both the openings in the bottom support rail 26 and the handrail 22 to be opened and closed with one gate member. The handrail gate member 37 has a tubular support end portion 41 on each end thereof which fits onto the top of the ends of the handrail 22 adjacent the opening 33 while the body rail gate member 36 has a pair of clip members 42 which clip onto a pair of gate attaching protrusions 43, one on each side of the rail support member 34 adjacent the opening 32. The gate may also be covered with a netting, as shown in FIGS. 1 and 2, and may be lifted with one hand by grabbing any portion thereof and lifting upward to allow a fisherman 13 to enter thereinto and stand on the floor 25. The gate 35 may then be reattached by simply sliding it back into place with the clips 42 attaching to the gate attaching protrusions 43 with the handrail gate member 37 support ends 41 resting on the handrail 22.

The platform 10 may be attached to the bow 11 of a boat 12 by having the feet 20 bolted to the bow of the boat or using a turnbuckle attached to the bow of the boat. The feet 20 can allow the platform to be removably attached to the bow of the boat. The casting platform, however, may be permanently attached with threaded fasteners or by any means desired.

It should be clear at this time that a casting platform for a fishing boat has been provided which is especially adaptable for fly fishing but which can be used for other fishing techniques as desired. The platform can be any height desired and may be attached to the hull of a boat as shown but may also be on the stern of the boat or attached to any part of the boat desired. However, the present invention is not to be construed as limited to the forms shown which are to be considered illustrative rather than restrictive.

I claim:

1. A casting platform for a fishing boat comprising:

a frame having a plurality of leg members each having two ends and being attached together by a plurality of brace members, each brace member extending generally perpendicular to a pair of said leg members and being attached to each of said pair of leg members;

a floor supported on a plurality of said brace members for supporting a person thereon;

a generally C-shaped hand rail attached to one end of each of said plurality of leg members; and a generally C-shaped body support rail having a plurality of body rail support members attached to said plurality of leg members, said support rail being located inside of said hand rail for supporting a person thereagainst; and a net extending between said hand rail and said body support rail;

whereby a casting platform for a boat hull can support a person thereon.

2. The casting platform in accordance with claim 1 in which each of said plurality of leg members is curved outward from the other end thereof from said one end thereof.

3. The casting platform in accordance with claim 2 having four leg members.

4. The casting platform in accordance with claim 2 in which said hand rail is attached to each of said plurality leg members one end.

5. The casting platform in accordance with claim 1 in which said net is attached to said hand rail and extends around a plurality of said brace members and is attached to said body support rail.

6. The casting platform in accordance with claim 5 in which each of said plurality of leg members is an elongated tubular frame member.

7. The casting platform in accordance with claim 6 in which each of said brace members is a tubular member.

8. The casting platform in accordance with claim 7 in which said hand rail is tubular.

9. The casting platform in accordance with claim 8 in which said body support rail is tubular.

10. The casting platform in accordance with claim 9 in which said generally C-shaped hand rail has an opening sized to a allow a person to fit therethrough.

11. The casting platform in accordance with claim 10 in which said generally C-shaped body support rail has an opening therein sized to a allow a person to fit therethrough.

12. The casting platform in accordance with claim 11 including a removably attached body rail member extending across said body support rail opening.

13. The casting platform in accordance with claim 12 including a removably attached hand rail member extending across said hand rail opening.

14. The casting platform in accordance with claim 13 in said removably attached body rail member and said removably attached hand rail member are attached together.

15. The casting platform in accordance with claim 14 in said removably attached body rail member and said removably attached hand rail member are attached together by a plurality of curved support members.

16. The casting platform in accordance with claim 15 in which said removably attached body rail member and said removably attached hand rail member have a net attached therebetween.

17. The casting platform in accordance with claim 15 in said removably attached body rail member has a pair of clip members attached thereto for attaching to a pair of protrusions extending from said body support rail.

18. The casting platform in accordance with claim 1 in which each of said plurality of leg members has a foot attached to the other end thereof.

* * * * *